US005603219A

United States Patent [19]

Kolb

[11] Patent Number: 5,603,219

[45] Date of Patent: Feb. 18, 1997

[54] ICE CELL FOR THE COOLING OF DRINKS

[76] Inventor: Anke Kolb, Conventstrasse 8-10, 22089 Hamburg, Germany

[21] Appl. No.: 490,582

[22] Filed: Jun. 15, 1995

[30] Foreign Application Priority Data

Feb. 7, 1995 [DE] Germany ..... 295 01 916.6

[51] Int. Cl.[6] ..... F25C 1/00

[52] U.S. Cl. ..... 62/1; 62/529

[58] Field of Search ..... 62/1, 529, 530

[56] References Cited

U.S. PATENT DOCUMENTS

| | | | |
|---|---|---|---|
| 740,847 | 10/1903 | Glebsattel | 62/530 |
| 1,923,522 | 8/1933 | Whitehouse | 62/530 |
| 2,152,467 | 3/1939 | Corsby | 62/530 |
| 2,264,971 | 12/1941 | Glennan | 62/530 |
| 3,095,291 | 6/1963 | Robbins | 62/530 X |
| 4,091,632 | 5/1978 | Marchewka et al. | 62/530 X |
| 4,325,230 | 4/1982 | Driscoll et al. | 62/530 X |

*Primary Examiner*—William E. Tapolcai
*Attorney, Agent, or Firm*—Diller, Ramik & Wight, PC

[57] ABSTRACT

An ice cell (10), provided for the cooling of drinks, comprises a closed hollow body (11) filled with a freezable liquid (16). The hollow body (11) is made at least partially of a transparent material and has least one insert (20) freely movable therein. The insert (20) can have a printing thereon, be colored or marked in any desired manner. e.g., to identify the drink contained in the glass.

5 Claims, 1 Drawing Sheet

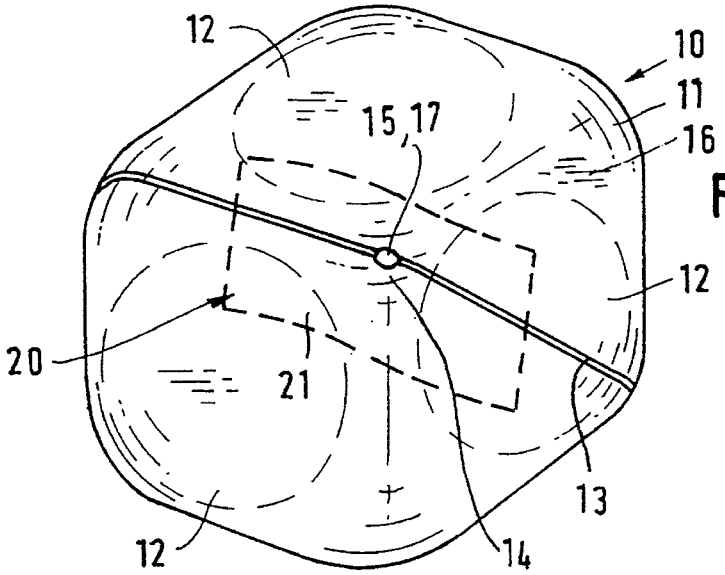
FIG.1
FIG.2
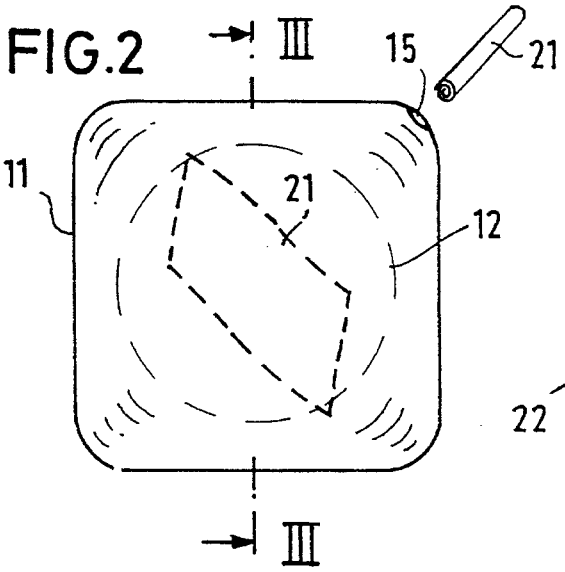
FIG.3
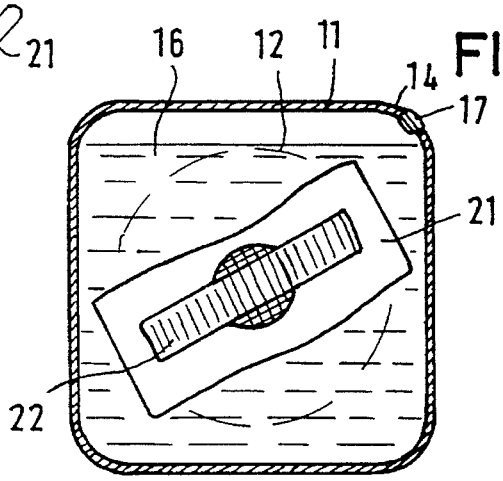
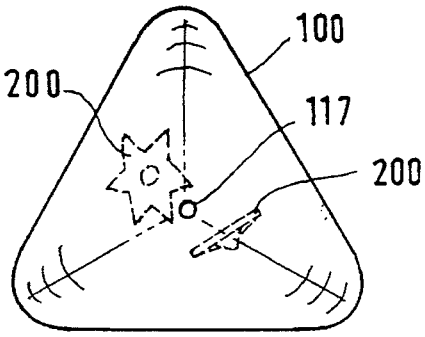
FIG.4
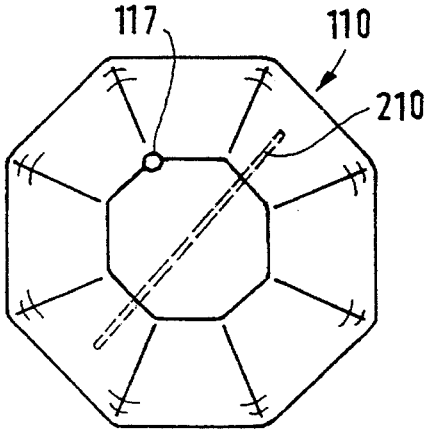
FIG.5

ICE CELL FOR THE COOLING OF DRINKS

The present invention is directed to an ice cell for the cooling of drinks, comprising a closed hollow body filled with a freezable liquid.

BACKGROUND OF THE INVENTION

Ice cells of the above type are known. An advantage of these ice cells resides in that the frozen liquid contained in the hollow body transmits cold to a drink without diluting the drink. After having been rinsed with water, the ice cell can be immediately returned to the deep-freeze compartment of a refrigerator and will soon be ready for use again. Presently, the hollow bodies of the ice cells have a spherical shape and are filled with a cooling gel which, however, if undesirably leaking out of a hole in the hollow body and entering the drink, is not without risk to a human's health. Ice cubes of the above type cannot be used to identify the drink in which they are used as a cooling element, because a printing on the outer surface of the hollow body would cause extreme problems due to the strict regulations of food law or similar legal provisions while, on the other hand, the application of a printing on the inner surface would be almost impossible or too expensive for technical reasons.

It is an object of the invention to provide an ice cell which can be used as an information carrier without resultant conflicts with the provisions of food law.

SUMMARY OF THE INVENTION

To solve the above object, the hollow body of the ice cell according to the invention is made at least partially of a transparent material and comprises at least one insert freely movable therein.

The freely movable insert floats in the cooling liquid and is visible from outside through the transparent wall of the hollow body. The insert can be colored or carry written or pictorial information to identify a drink. Thus, the cooling properties of the ice cell can be combined with the feature of identifiability without the risk of any contact between the drink and the printing ink or the like. When the liquid is being frozen, the insert attains a fixed position in the liquid and, depending on its orientation relative to the wall of the hollow body, is more or less visible from the outside. Thus, when using a plurality of hollow bodies in a drinking glass, each of the inserts will produce a different visual impression, resulting in a special optical effect. When the ice blocks within the hollow bodies are melting, the inserts are released from their fixed positions and start moving or floating within the hollow bodies so that an ornament and/or printing provided on the insert becomes visible ever more clearly.

The insert can be a sheet-like or three-dimensional object. Preferably, the insert carries a brand/label/logo or is, as a whole, a replica of a product. Preferably, the insert is made from a floatable flexible film of a synthetic material, e.g., a PVC (polyvinyl chloride) film, which is preferably provided as a strip. The dimensions of the insert are selected in such a manner that the insert can move without any restrictions in the interior of the hollow body and can unfold in the liquid to obtain its full sheet-like shape, so that the—preferably two-sided—ornament and/or printing on the insert is freely visible. By way of alternative to the strip-shape, the film of synthetic material can be shaped as a pad with any desired contours.

The film of synthetic material forming the insert can be transparent and can have both of its sides provided with a colored printing or printing layer. The colored printing has to be resistant to the freezable liquid and must not impair the ability of the sheet-shaped insert to float and stretch out in a flat shape, so as to prevent a deterioration of the eye-catching effect of the inventive ice cell which is obtained by the insert that has been frozen in its floating condition.

Neither the film nor the print need be in compliance with any provisions of food law because they do not contact the drink. Attention has to be paid merely to the floatability of the insert and the compatibility of the material of the the print with the freezable liquid so that the printing layer will neither dissolve or fade and will not impair the desired flat shape that the strip or the like is to take in the liquid after having been rolled for insertion into the hollow body.

The hollow body is suitably a geometric blow-molded body made from a transparent synthetic material. Preferred use is made of food-compatible PVC material which can be utilized without problems in alcoholic or non-alcoholic or soft drinks.

The geometric, particularly blow-molded body can be produced to have a large variety of rounded or edgy shapes. The preferred shape is that of a cube having rounded corners and edges. To the viewer, such a cube, with its frozen contents being visible through the transparent wall, creates the illusion of a conventional ice cube produced by freezing in a grid-partitioned water container, and the viewer will be surprised when this cube will not melt away.

On one of its corners, the cube is formed with an opening for inserting the rolled sheet insert and for filling in the liquid. To avoid aesthetic loss in the overall appearance of the cube, the opening is located on a corner of the solidified cube and after insertion of the insert and the liquid is tightly sealed by melting.

The freezable liquid to be filled into the cube is preferably water and—most preferably—distilled water which, should there be a leak in the walls of the hollow body due to unintentional breaking, will not be harmful to quality of the drink.

Preferred embodiments of the invention will be described hereunder with reference to the accompanying drawings.

BRIEF DESCRIPTION OF THE DRAWINGS

FIG. 1 is a perspective view of an ice cube with an insert therein,

FIG. 2 is a side view of the ice cube according to FIG. 1,

FIG. 3 is a sectional view along the line III—III in FIG. 2,

FIG. 4 is a plan view onto a pyramid-shaped hollow body of an ice cell, and

FIG. 5 a plan view of an octagonal hollow body of an ice cell.

DESCRIPTION OF THE PREFERRED EMBODIMENTS

The ice cell 10 according to FIGS. 1 to 3 comprises a hollow cube 11 delimited by six substantially plane surfaces 12 and made from a transparent synthetic material. Preferably, the synthetic material used is a PVC material in compliance with the provisions of food law. PVC, being a thermoplastic, can be formed in a blow molding machine. In this process, an extruder with a blow molding head is used to generate a mostly tubular preform which, while still being in a hot condition, is gripped by a blow molding tool and is widened by pressurized air to obtain the inner contour of the blow molding tool. By contacting the cold wall of the blow molding tool, the thermoplastic synthetic material solidifies in the shape of the desired molded article, i.e.—in the present case—in the shape of the cube 11 with the rounded corners and edges. On the confronting contacting edges of the blow molding tool release surfaces, a joint line 13 is formed which in the illustrated example extends diagonally over two surfaces 12 and two corners. Because of the rounded shape of the edges and corners, each surface 12 is substantially circular. The edge length of the symmetrical cube 11 ranges from 20 mm to 25 mm.

An opening 15 is formed on one corner 14 of cube 11. Opening 15 is used to fill freezable liquid, preferably distilled water 16, into the cube cavity. Further, opening 15 serves for insertion of an insert 20 into cube 11. After filling the cube 11 and inserting the insert 20 into it, the opening 15 is closed by a plug 17 of a synthetic material which under the influence of heat will fuse with the material of the cube wall.

In the illustrated example, insert 20 is provided as a rectangular strip 21 made from a thin flexible film of synthetic material. The synthetic film of insert 20 can be colored or transparent and be provided with a printing, so that the strip 21, freely floating in the distilled water 16, is distinctly visible and even in the frozen state of the water 16 can still be seen through the transparent wall of cube 11. Strip 21 acts as a sort of identification flag within the ice block, be it that glasses having cubes 11 with differently colored strips 21 placed therein are assigned to different persons according to the respective color, or that easy identification of the kind of drink in the glass is desired, e.g., to facilitate the choice among several offered drinks without the need for further questions.

While FIGS. 1 and 2 are merely schematic representations of the strip 21, FIG. 3 shows a special embodiment of strip 21. In the embodiment according to FIG. 3, the rectangular strip 21 is made from a transparent PVC film and has both sides provided with a printing 22 in its longitudinal and transverse central regions at a distance from the edge. Since neither strip 21 nor printing 22 will come in contact with the drink, any desired printing colors can be used. In applying the printing 22, it has to be observed that the printing should not prevent the strip 21 from fully unfolding in the water 16 from its rolled condition (cf. FIG. 2) provided for insertion of strip 21 through opening 15, so that the strip 21 will unwind to take on a substantially flat, extended shape and its printing 22 will be clearly visible. Further, the printing 22 must not impair the floatability of strip 21 so that strip 21 will not always lie flatly on the inner side of a cube surface 12 but move into random floating positions within the water 16, providing special optical effects also in the frozen condition.

The statements rendered above on FIGS. 1 to 3 apply likewise to the embodiment according to FIGS. 4 and 5. The hollow pyramid 111 of ice cell 100 and the hollow octagonal body 211 of ice cell 110 are blow-molded bodies of a transparent synthetic material and are each provided with an opening 117 for inserting an insert 200 and 210, respectively, and water into the cell, with opening 117 being closeable by melting.

The insert 200 of the embodiment according to FIG. 4 is also made from a floatable, flexible film of synthetic material. By way of alternative to the shape of strip 21 discussed above, insert 200 is star-shaped, and two inserts 200 are provided in the pyramid, floating therein or being positionally fixed by ice.

The insert 210 of the embodiment according to FIG. 5 is of a longitudinal shape. Also insert 210 is made from a floatable, flexible film of synthetic material. Insert 210 can carry a printing thereon or be made from a colored material, and its contours can be selected as desired.

I claim:

1. An ice cell for the cooling of drinks comprising a closed hollow body filled with a freezable liquid, said the hollow body being made at least partially of a transparent material, at least one insert freely movable in said hollow body, said insert being made from a floatable, flexible film of synthetic material, and said hollow body having an opening sized for insertion therethrough of the flexible film as a rolled insert and for filling the hollow body therethrough with the freezable liquid.

2. The ice cell according to claim 1 wherein said insert is formed as a strip.

3. The ice cell according to claim 1 wherein said hollow body is a geometric blow-molded body made from transparent synthetic material.

4. The ice cell according to claim 1 wherein said hollow body is a cube having rounded corners and edges.

5. The ice cell according to claim 1 wherein the freezable liquid is water and preferably distilled water.

* * * * *